US012005287B2

(12) United States Patent
Yeh

(10) Patent No.: US 12,005,287 B2
(45) Date of Patent: Jun. 11, 2024

(54) EXPLOSIVE STRENGTH TRAINING DEVICE

(71) Applicant: Hong-Jun Yeh, Taichung (TW)

(72) Inventor: Hong-Jun Yeh, Taichung (TW)

( * ) Notice: Subject to any disclaimer, the term of this patent is extended or adjusted under 35 U.S.C. 154(b) by 127 days.

(21) Appl. No.: 17/973,474

(22) Filed: Oct. 25, 2022

(65) Prior Publication Data

US 2023/0131649 A1 Apr. 27, 2023

(51) Int. Cl.
*A63B 21/00* (2006.01)
*A63B 21/005* (2006.01)
*A63B 24/00* (2006.01)

(52) U.S. Cl.
CPC .... *A63B 21/00196* (2013.01); *A63B 21/0058* (2013.01); *A63B 21/154* (2013.01); *A63B 24/0087* (2013.01)

(58) Field of Classification Search
CPC ..... A63B 21/00196; A63B 21/0058; A63B 21/154; A63B 24/0087; A63B 21/0428; A63B 21/0552; A63B 21/4043; A63B 21/0628
See application file for complete search history.

(56) References Cited

U.S. PATENT DOCUMENTS 4,678,184 A * 7/1987 Neiger ..... A63B 21/153 482/4
5,328,429 A * 7/1994 Potash ..... A63B 21/0058 482/99
5,433,678 A * 7/1995 Chi ..... A63B 21/0058 482/99
5,697,869 A * 12/1997 Ehrenfried ..... A63B 21/157 482/7
6,217,491 B1 * 4/2001 Schiessl ..... A61H 1/005 482/148
7,537,552 B2 * 5/2009 Dalebout ..... A63B 23/1209 482/121
7,682,287 B1 * 3/2010 Hsieh ..... A63B 21/153 482/4
8,968,155 B2 * 3/2015 Bird ..... A63B 21/156 482/4
11,040,231 B2 * 6/2021 Rubin ..... A63B 71/0622
11,285,355 B1 * 3/2022 Nicholson ..... A63B 21/15
11,452,903 B2 * 9/2022 Watterson ..... A63B 23/1236
2008/0300116 A1 * 12/2008 Eder ..... A63B 21/063 482/100
2009/0029835 A1 * 1/2009 Ellis ..... A63B 21/4035 482/97
2012/0053014 A1 * 3/2012 Zhu ..... A63B 21/4035 482/5
2014/0038777 A1 * 2/2014 Bird ..... A63B 23/03525 482/5

(Continued)

*Primary Examiner* — Garrett K Atkinson

(57) ABSTRACT

An explosive strength training device is provided. The explosive strength training device includes a cable set, a power box, a resistance motor and a controller. The cable set includes a rubber belt and a movable pulley block connected with one end of the rubber belt, the movable pulley block has a first main pulley disposed opposite to the rubber belt, and allows the pulling force of the rubber belt to pass through the center of the first main pulley. Through the labor-saving structure of the first main pulley, the middle section of the power belt is wound on the upper side of the first main pulley and fixedly sleeved on the positioning rod with the fixed side to form a fulcrum.

17 Claims, 19 Drawing Sheets

(56) References Cited

U.S. PATENT DOCUMENTS

| | | | | |
|---|---|---|---|---|
| 2018/0021616 | A1* | 1/2018 | Orady | A63B 24/0087 482/5 |
| 2019/0160324 | A1* | 5/2019 | Leopoldo Da Camara Filho | G05B 19/048 |
| 2020/0047055 | A1* | 2/2020 | Ward | A63B 21/0058 |
| 2021/0220696 | A1* | 7/2021 | Carruthers | A63B 21/00069 |

* cited by examiner

A perspective schematic view of amplitude change of the explosive strength training device in operation

EXPLOSIVE STRENGTH TRAINING DEVICE

FIELD OF THE DISCLOSURE

The present disclosure relates to a technical field of sports equipment, and more particularly to a device that can directly upgrade the equipment from conventional muscle strength training to explosive strength training.

BACKGROUND OF THE DISCLOSURE

Conventional equipment for muscle strength training, such as weightlifting equipment, chest expansion equipment, pulling equipment, etc., provides users with the effect of muscle strength training by means of resistance to load movement. The aforementioned load movement of the sports equipment is mainly provided by the tension rope and the metal block hanging the weight, and the amount of the metal blocks (increase or decrease the weight) is used as the resistance for training.

Although the aforementioned sports equipment for muscle strength training can adjust the load weight by changing the number of metal blocks. However, adding or reducing the metal blocks is time-consuming, and the load adjustment cannot be made immediately. Moreover, the weight of the metal block is fixed; it is not easy to fine-tune the load weight according to the training situation. As a result, the training mode is too standardized, making it challenging to enhance the explosive force.

SUMMARY OF THE DISCLOSURE

The main objective of the present disclosure is to solve the problem that the conventional muscle strength training equipment cannot adjust the load weight immediately, and the load weight is not easy to be fine-tuned according to the training situation, so that the training mode is too fixed. It is difficult to help the explosive force. The load weight can be fine-tuned in time through the electrical control of the controller and the resistance motor. The frame of the conventional strength training equipment can be retained, and only require replacing the metal block with the present disclosure, which can avoid resource waste and be more environmentally friendly.

In order to achieve the above-mentioned objective and effort, the present disclosure provides an explosive strength training device, including a cable set, a power box, a resistance motor and a controller. The cable set includes a rubber belt and a movable pulley block connected with one end of the rubber belt, the movable pulley block has a first main pulley disposed opposite to the rubber belt, and allows the pulling force of the rubber belt to pass through the center of the first main pulley. The power box includes an outer face and a positioning rod protruding from the outer face. The resistance motor is disposed in the power box and has a central axis protruding through the outer face, in which the central axis protrudes from the outer face and is located under the positioning rod and combined with a central wheel; wherein the central wheel winds with one end of a power belt. The other end of the power belt has a sleeve-shaped fixed side; the middle section of the power belt is wound on the upper side of the first main pulley and fixedly sleeved on the positioning rod with the fixed side to form a fulcrum. The controller is electrically connected to the resistance motor, for controlling the resistance motor to output the reverse resistance force of the rubber belt on the central wheel.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
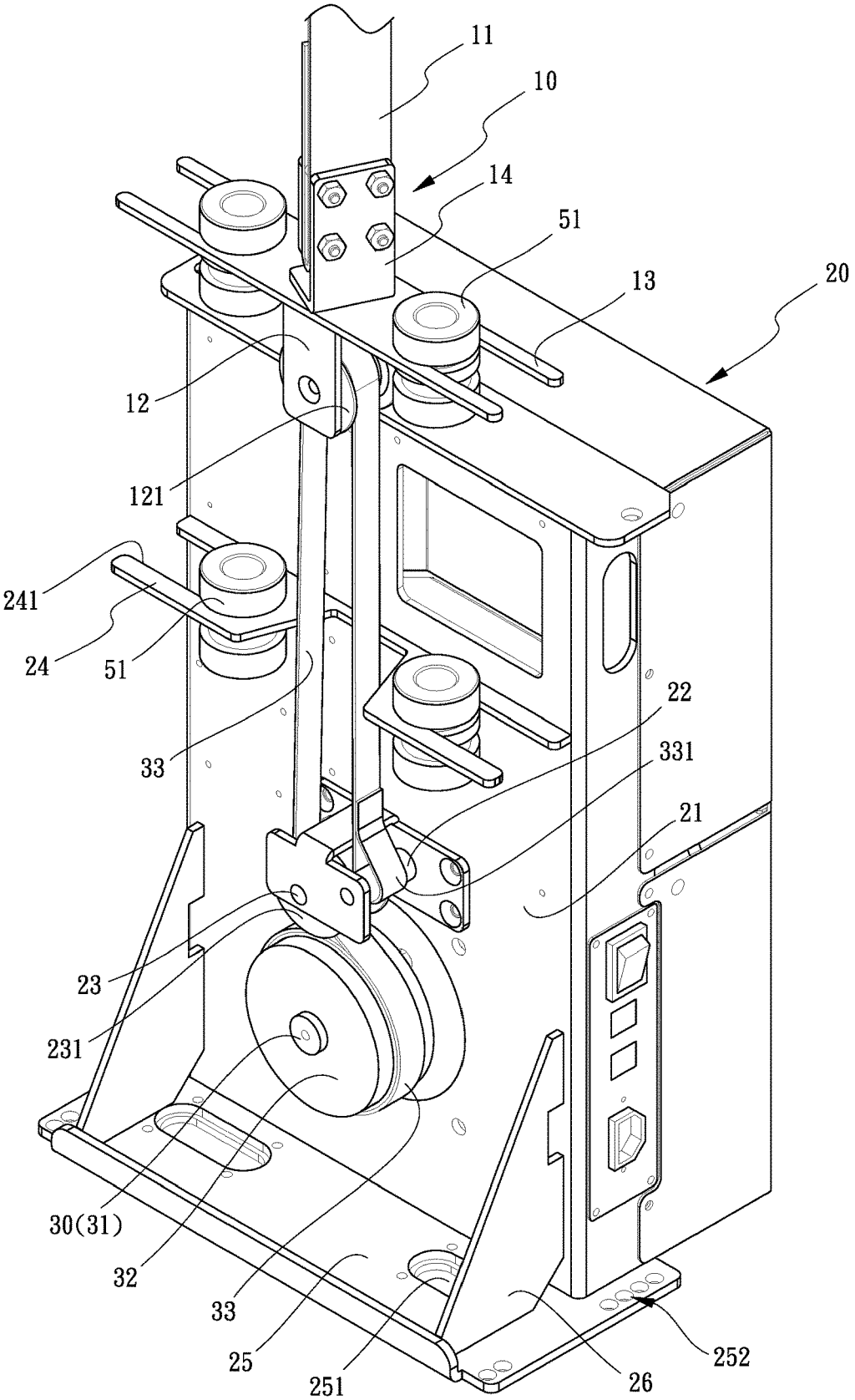
FIG. 1 is an assembled perspective schematic view of the first embodiment of the present disclosure.
Figure 2:
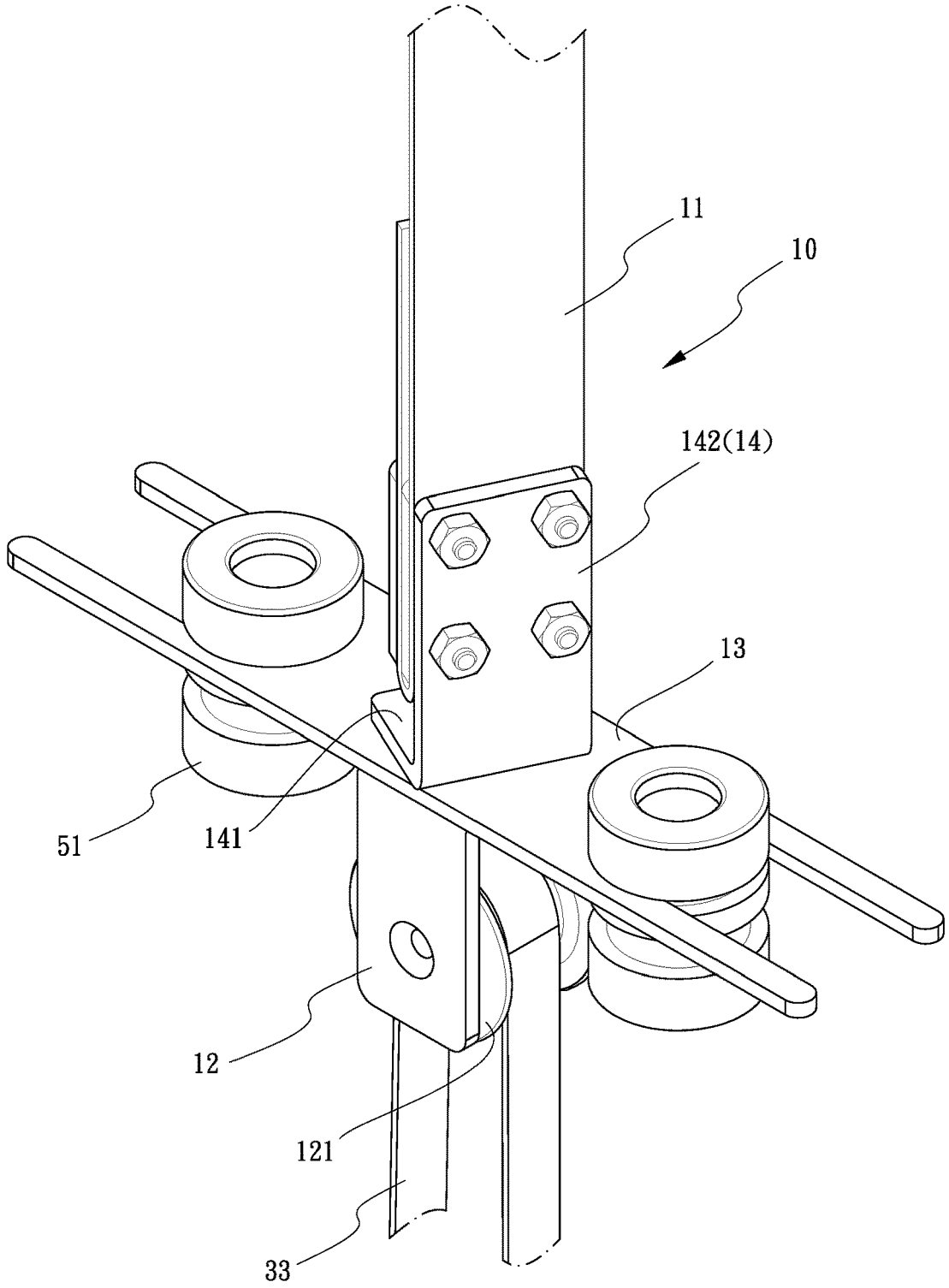
FIG. 2 is an assembled perspective schematic view of the cable set of the first embodiment of the present disclosure.
Figure 3:
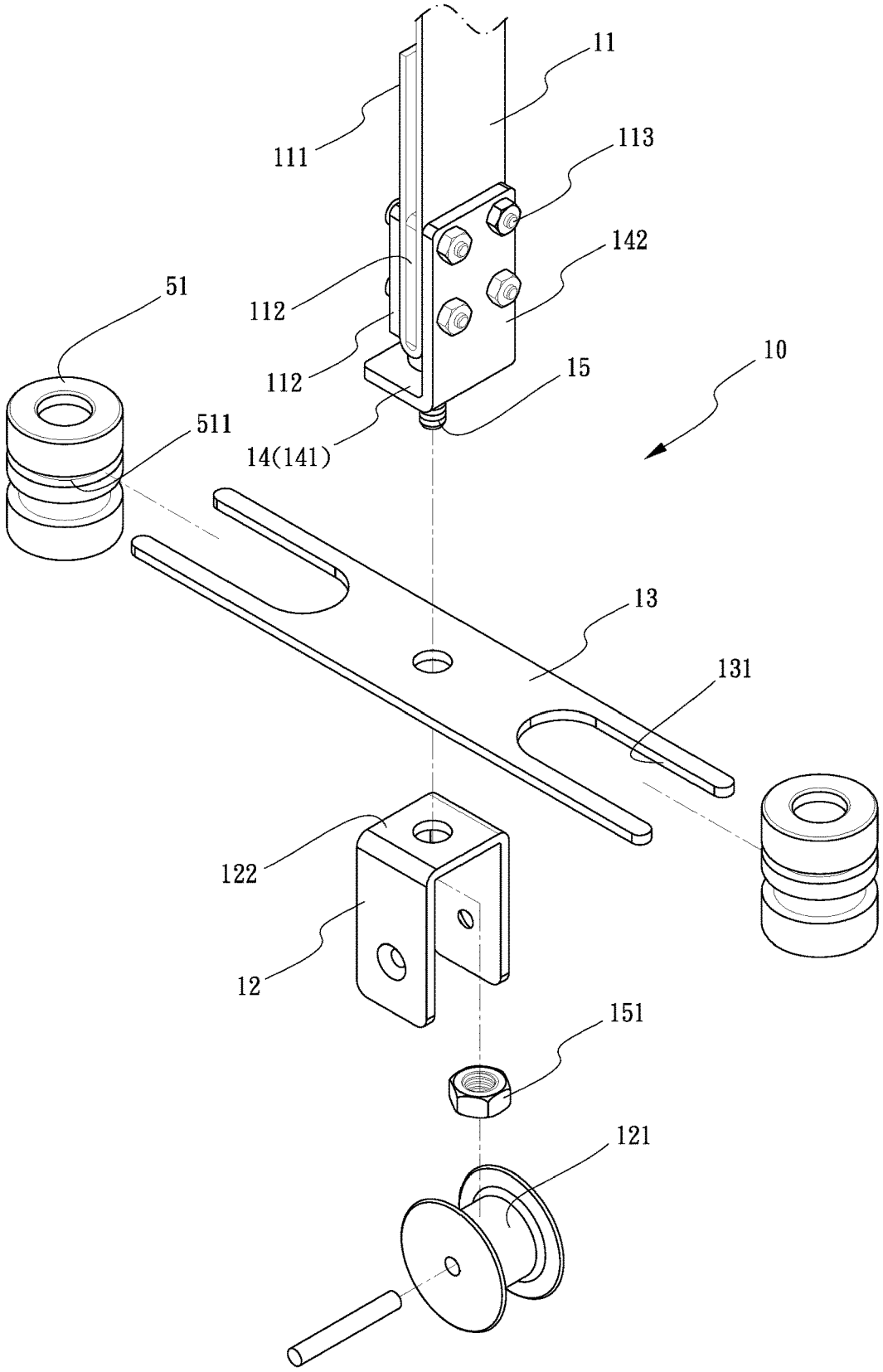
FIG. 3 is an exploded perspective schematic view of the cable set of the first embodiment of the present disclosure.
Figure 4:
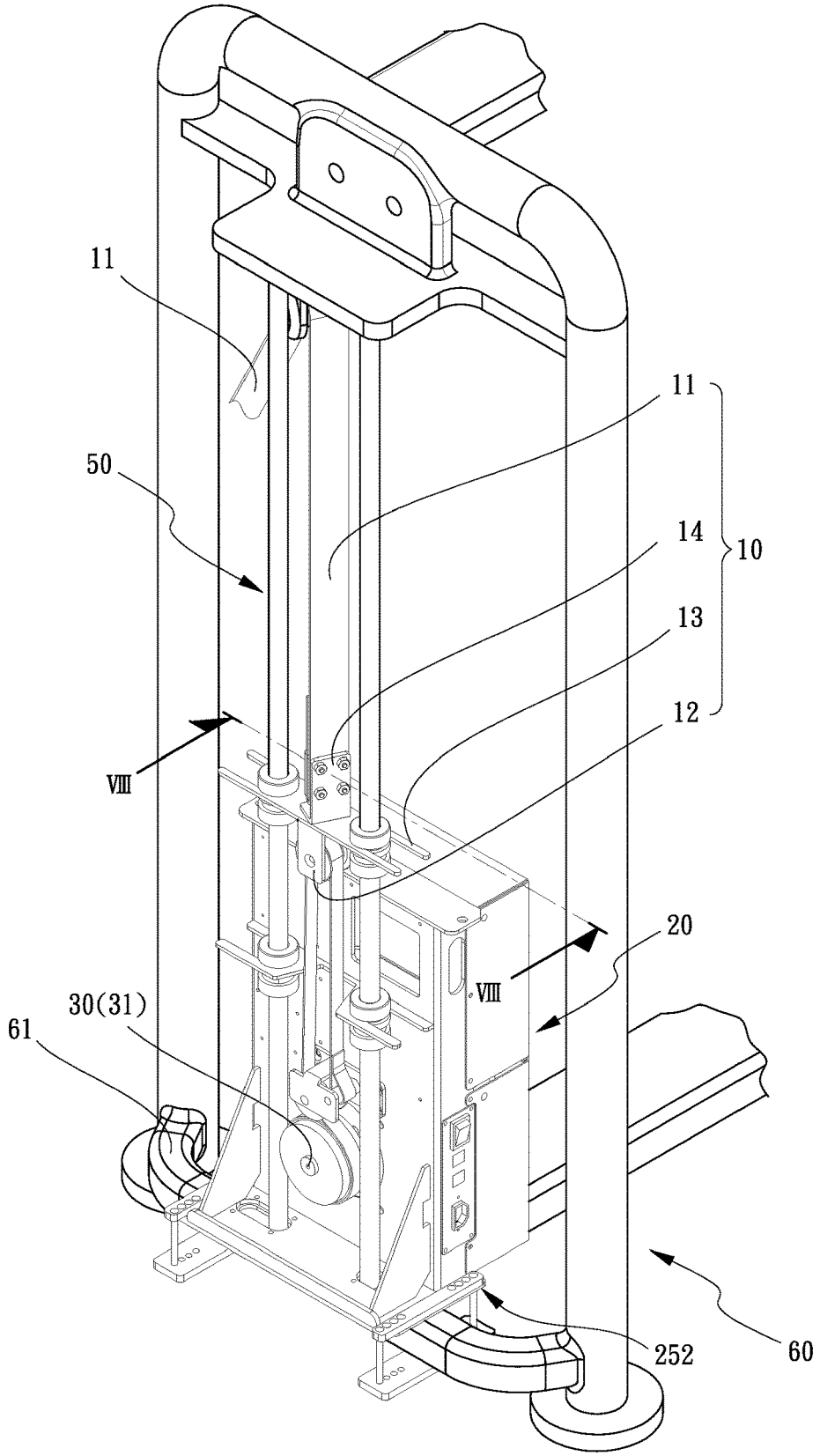
FIG. 4 is a perspective schematic view of the first embodiment of the present disclosure in operation.
Figure 5:
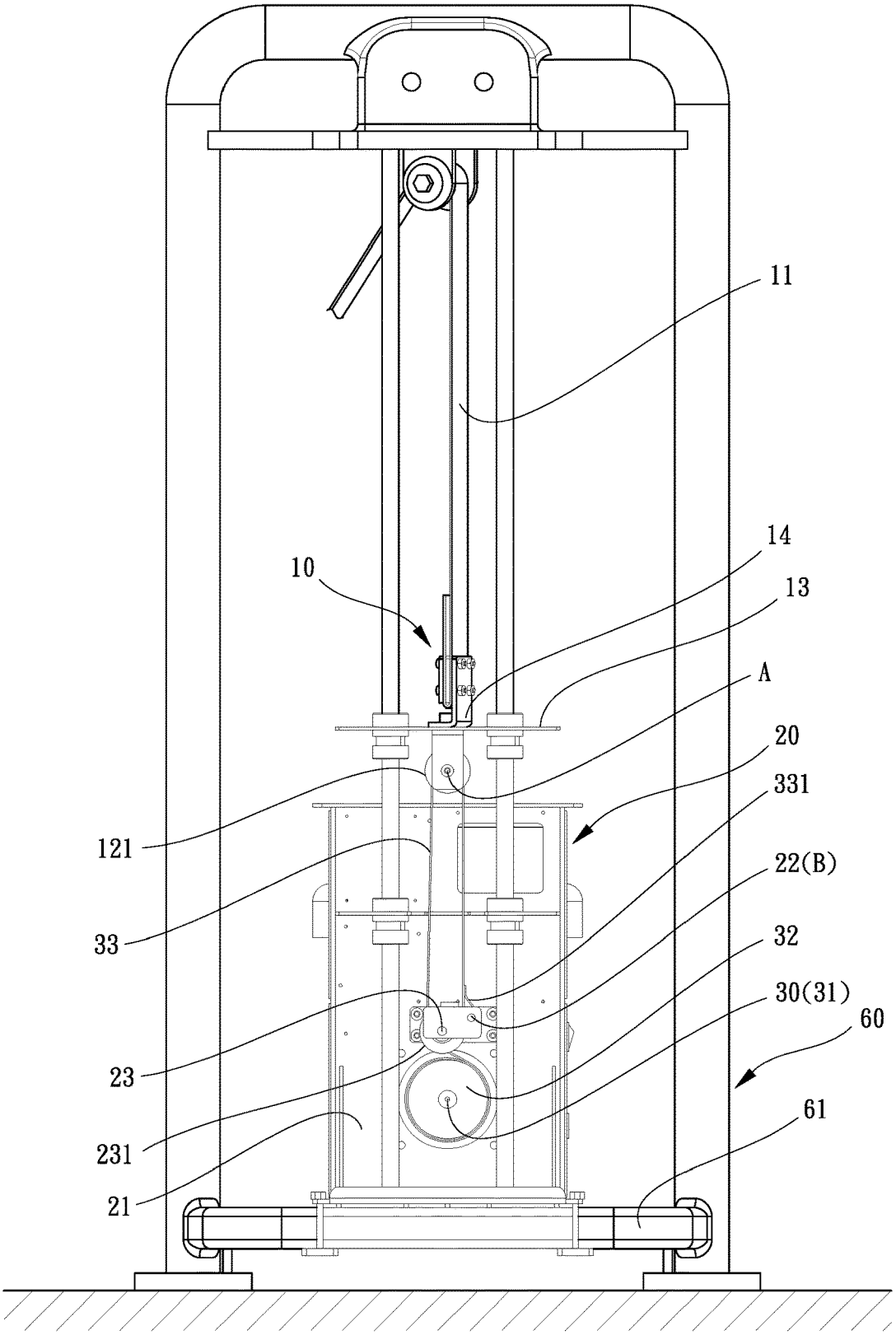
FIG. 5 is a planar schematic view of the rear view of the first embodiment of the present disclosure in operation.

Referring to FIGS. 1-14, the present disclosure provides an explosive strength training device, which can be described in the two embodiments. As shown in FIGS. 1-10, the first embodiment discloses the explosive strength training device, comprising: a cable set 10, a power box 20, a resistance motor 30 and a controller 40.

The cable set 10 includes a rubber belt 11 and a movable pulley block 12 connected with one end of the rubber belt 11, the movable pulley block 12 has a first main pulley 121 disposed on the opposite end of the rubber belt 11, and allows the pulling force of the rubber belt 11 to pass through the center A of the first main pulley 121.

The power box 20 includes an outer face 21 and a positioning rod 22 protruding from the outer face 21.

The resistance motor 30 (In this embodiment, it is a servo motor) is disposed on the power box 20 and has a central axis 31 protruding through the outer face 21. The central axis 31 protrudes from the outer face 21 and is located under the positioning rod 22 and supports a central wheel 32. The central wheel 32 winds with one end of a power belt 33. The other end of the power belt 33 has a sleeve-shaped fixed side 331, the middle section of the power belt 33 is wound on the upper side of the first main pulley 121 and fixedly sleeved on the positioning rod 22 with the fixed side 331 to form a fulcrum B.

Figure 9:
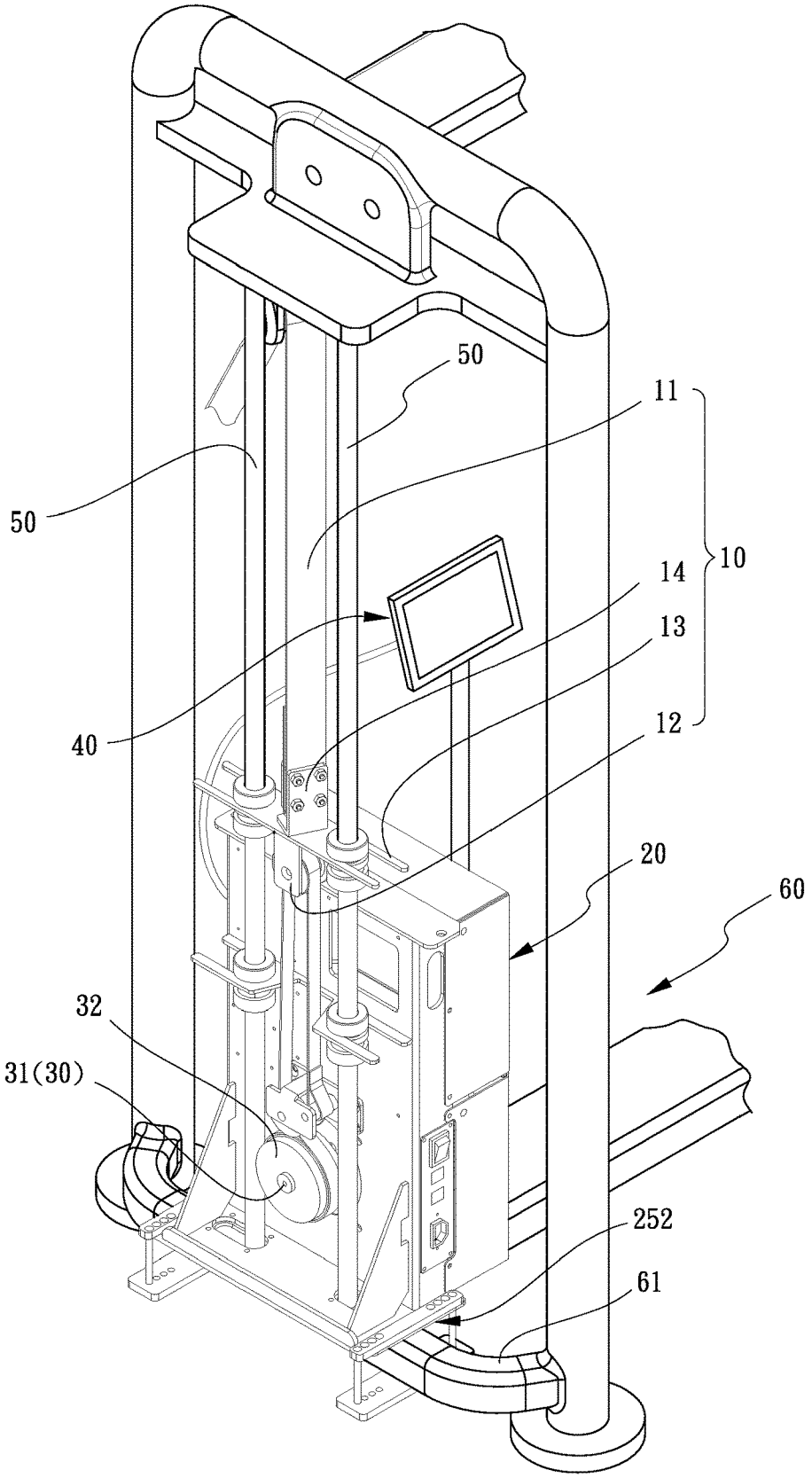
FIG. 9 is a perspective schematic view of the resistance motor electrically connected to a controller of the present disclosure.
Figure 10:
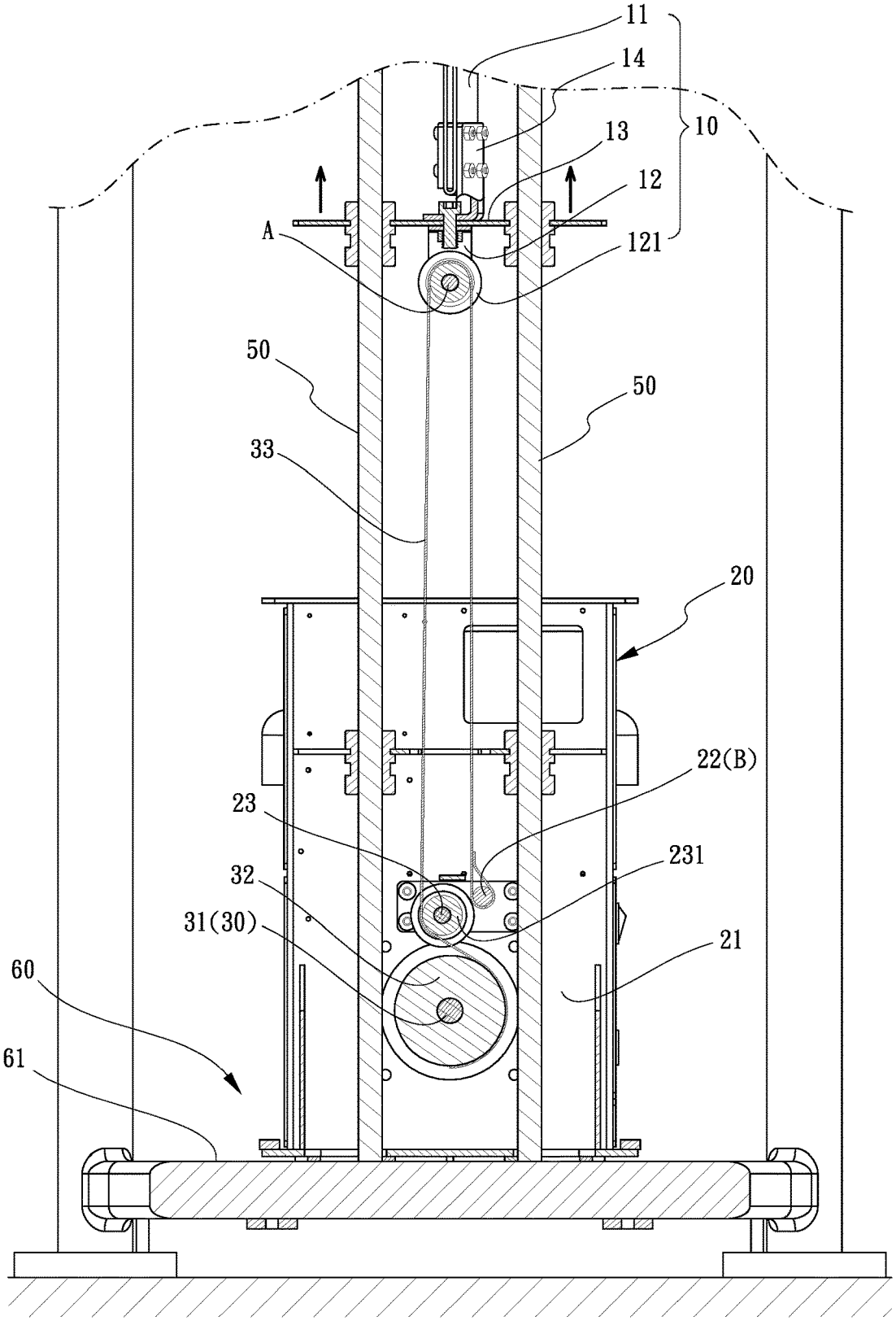
FIG. 10 is a schematic view of the movable pulley block and the horizontal guide plate
Figure 11:
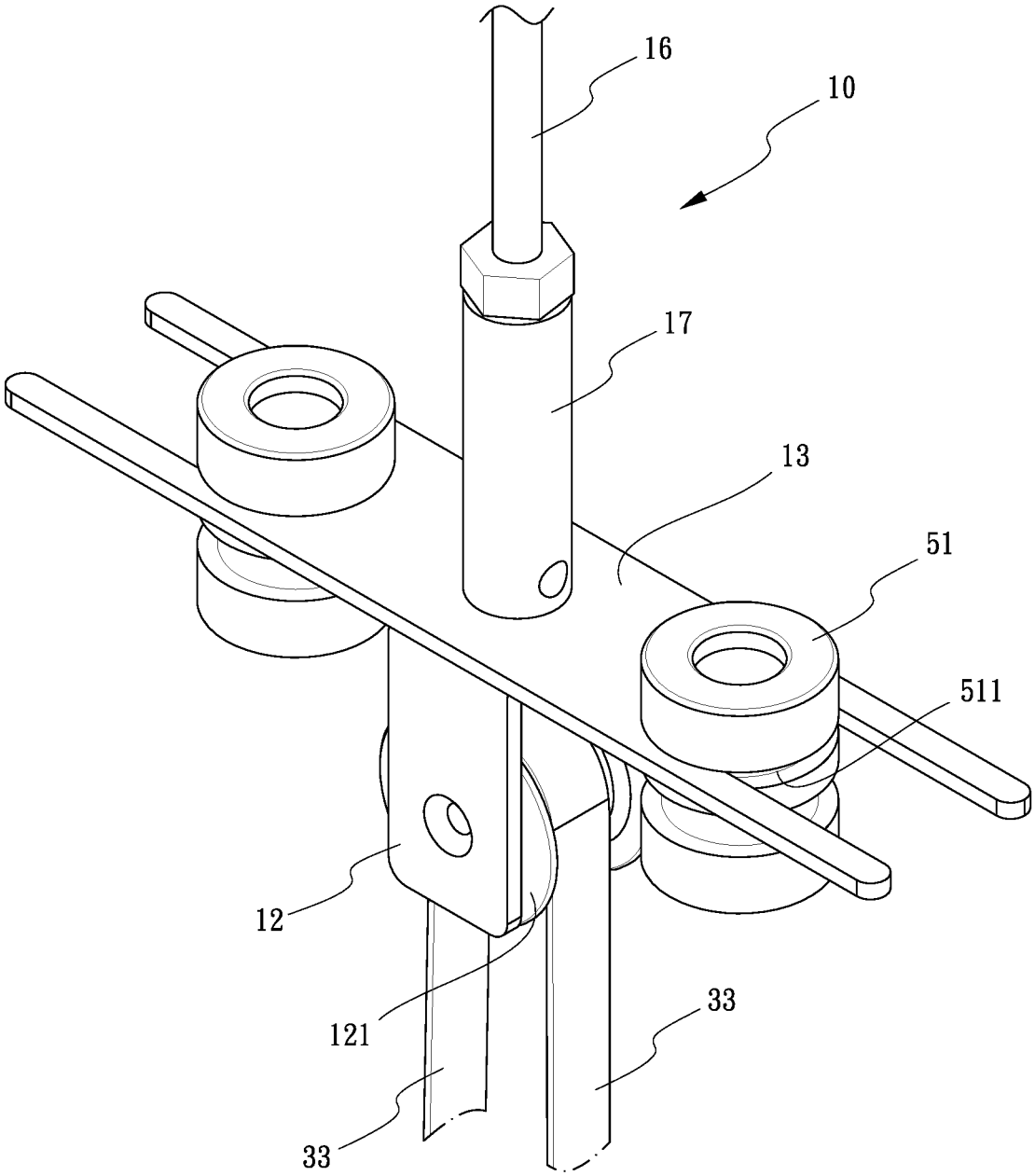
FIG. 11 is an assembled perspective schematic view of the second embodiment of the cable set of the present disclosure.
Figure 12:
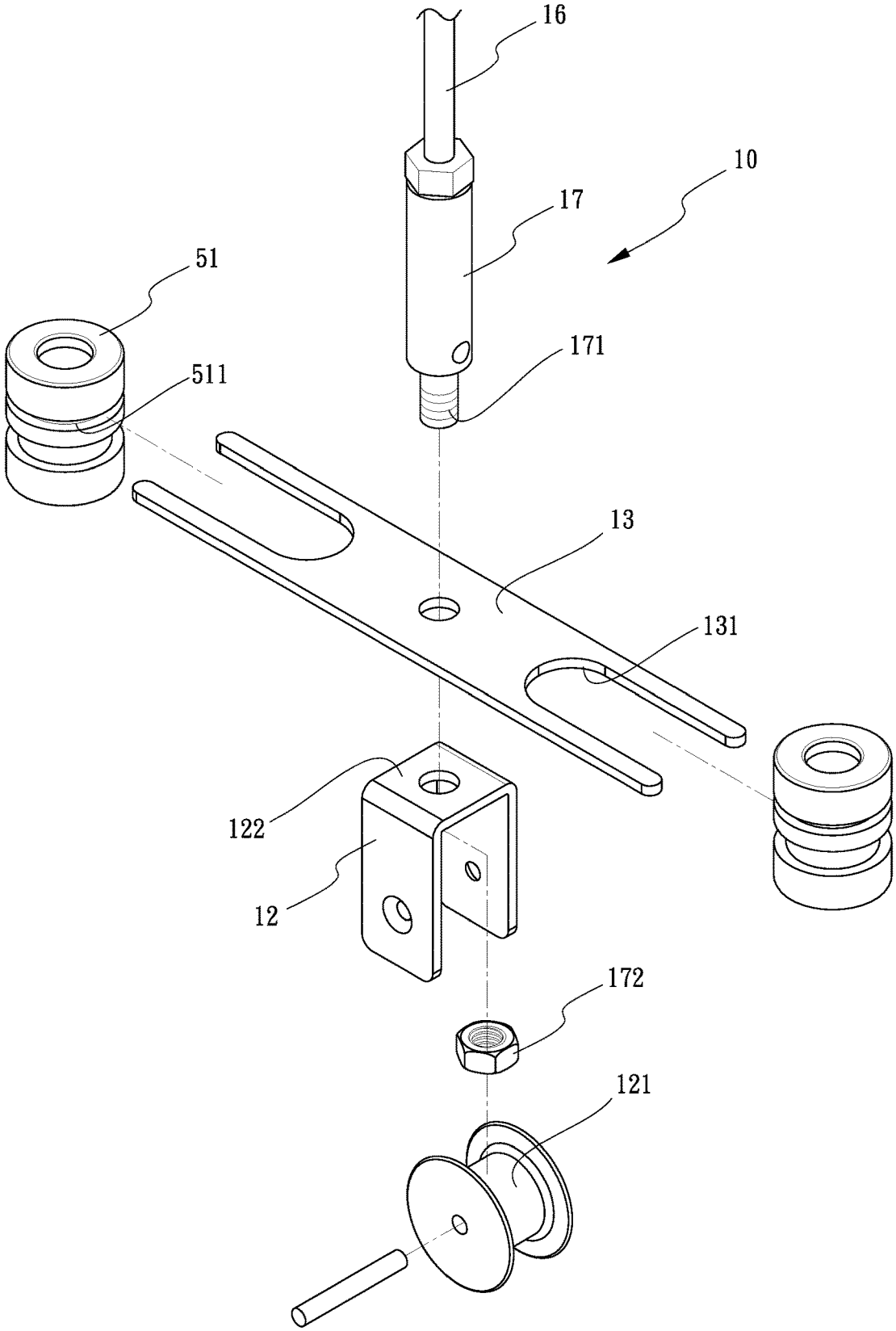
FIG. 12 is an exploded perspective schematic view of the second embodiment of the cable set of the present disclosure.
Figure 13:
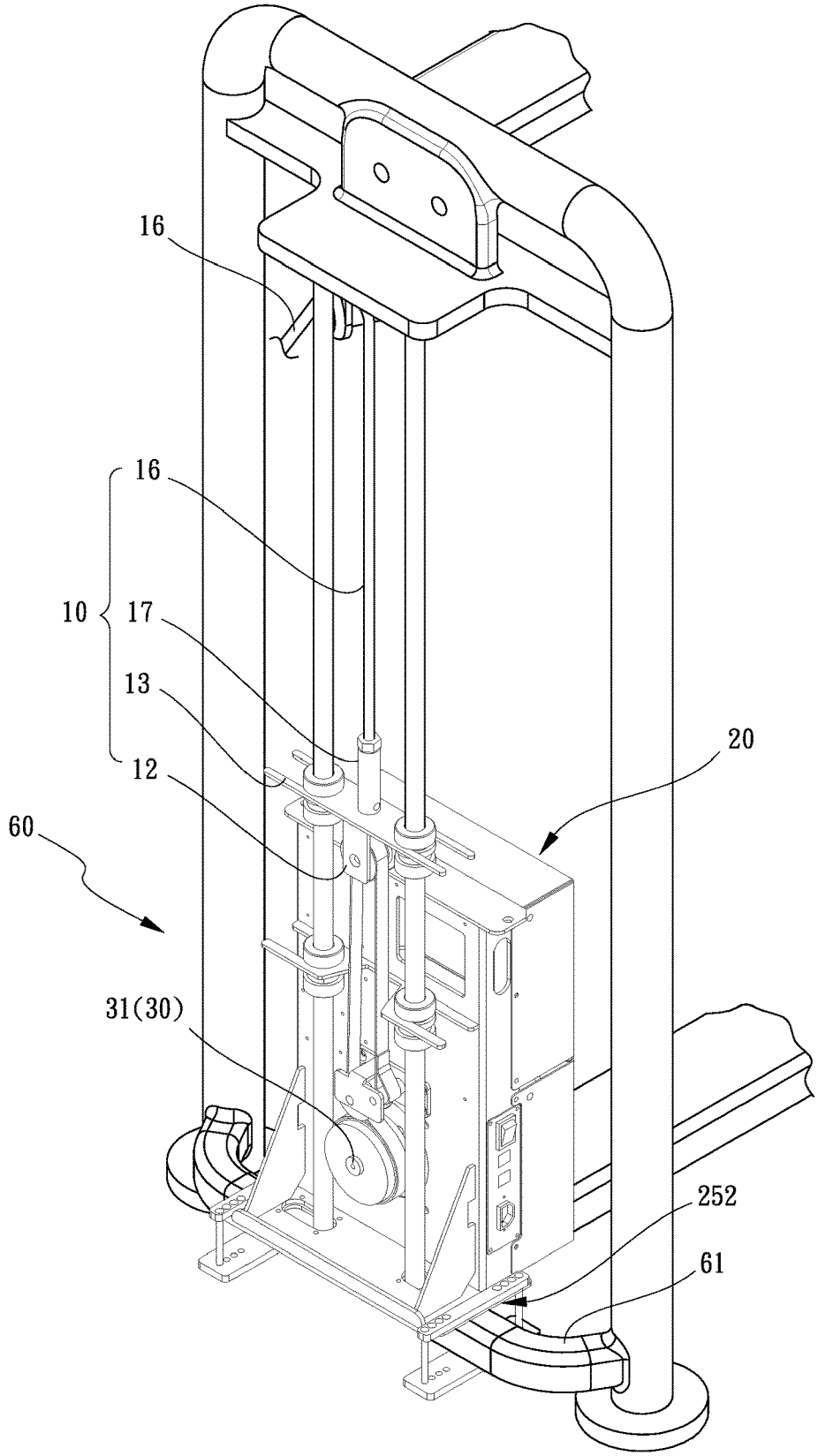
FIG. 13 is a perspective schematic view of the second embodiment of the cable set of the present disclosure in operation.
Figure 14:
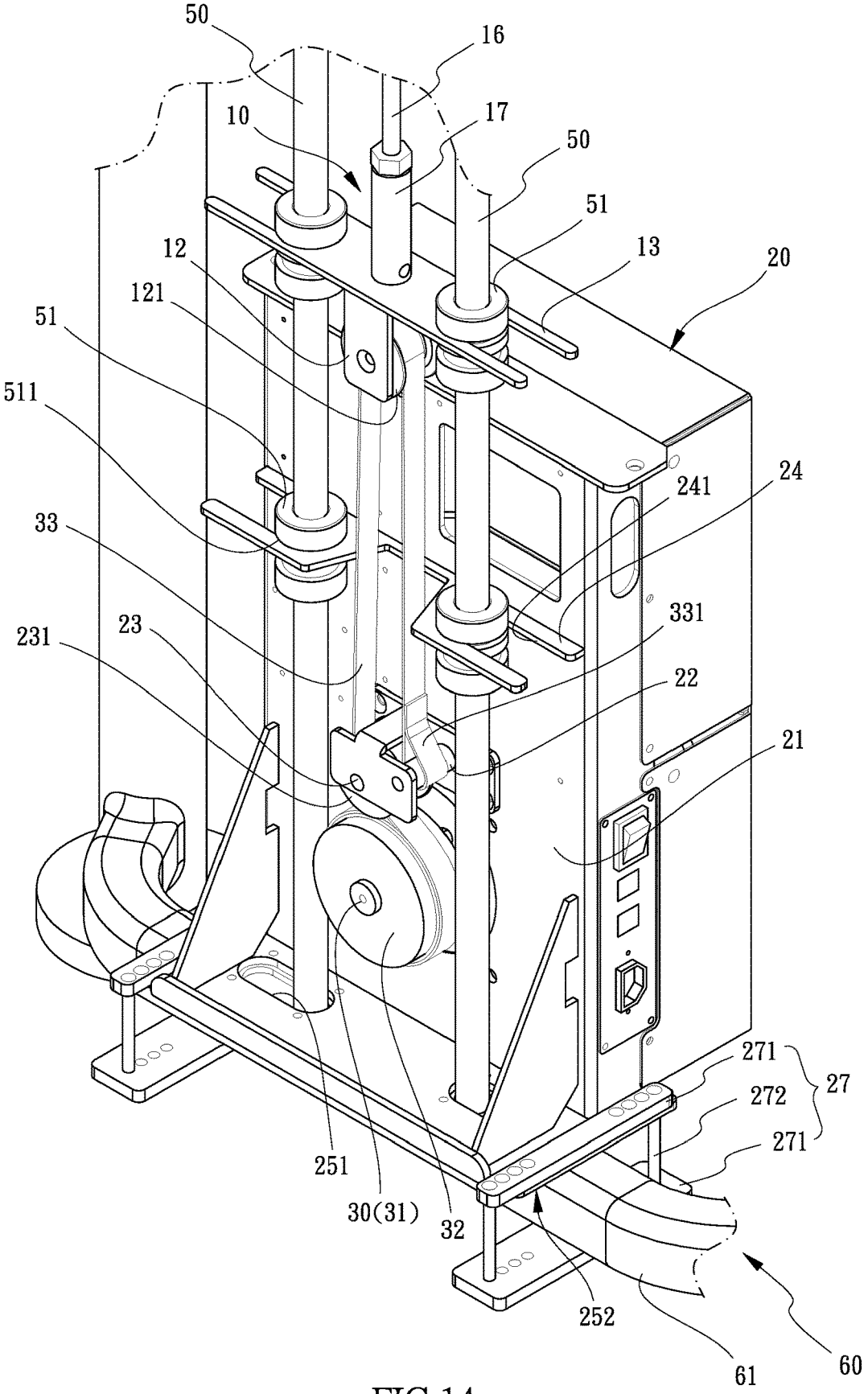
FIG. 14 is a partial enlarged perspective schematic view of the lower section structure of FIG. 13.

As shown in FIG. 9, the controller 40 is electrically connected to the resistance motor 30, for controlling the resistance motor 30 to output the reverse resistance force of the rubber belt 11 on the central wheel 32.

Further, as shown in FIGS. 4-8, the first embodiment is more particularly described in the following description. The explosive strength training device of the present disclosure is mounted on a training machine 60, the two guide rods 50 and the power box 20 with the resistance motor 30 are mounted on the base frame 61 of the training machine 60.

As shown in FIGS. 5-8, the power belt 33 is wound on the upper side of the first main pulley 121 and fixedly sleeved on the positioning rod 22 with the fixed side 331 to form a fulcrum B, The other end of the power belt 33 winds upwards through the upper side of the first main pulley 121 and connects downwardly to the central wheel 32. When the user under training pulls the rubber belt 11, the movable pulley block 12 and the horizontal guide plate 13 are pulled along the direction of the arrow in FIG. 8 to the position shown in FIG. 10. Due to the pulling force of the rubber belt 11 passing through the center A of the first main pulley 121, the relative fulcrum B will form an upward force by the radius of the first main pulley121 (as the forcing arm), and the pulling force that generated by the resistance motor 30 controls the central wheel 32 to wind and pull the power belt 33 will form a resistance arm. The length of the resistance arm is equal to the diameter of the first main pulley 121, which is twice of the forcing arm (the radius of the first main pulley 121). Therefore, the resistance motor 30 only needs to output half of the force and can resist the force operated by the user for training. The present disclosure further effectively reduces the load of the motor and the power consumption, lowers the cost, and improves the smoothness of use and user favorability. Compared with conventional training equipment, the present disclosure can achieve a better explosive training effect by the monitor the output mode of the resistance motor 30 by the controller 40. The frame of the conventional strength training equipment can be retained, and only require replacing the metal block with the present disclosure, which can avoid resource waste and be more environmentally friendly.

The features of the elements of the first embodiment of the present disclosure are described in further detail below. In FIGS. 1-10, the power box 20 has a pulley rod 23 protruding from the outer face 21, and a second main pulley 231 is supported by the pulley rod 23 and limited by the positioning rod 22. The power belt 33 extends through the second main pulley 231 from the side distant from the positioning rod 22 downward to connect the central wheel 32. Further, as shown in FIG. 8A, which is a sectional schematic view of another assembled structure of the first embodiment of the present disclosure. The power box 20 has a limiting pulley 28 disposed at the opposite side to the positioning rod 22 for limiting the power belt 33 with the second main pulley 231 from offsetting from the central wheel 32. Therefore, the second main pulley231 provides stable guidance for the power belt 33 windy operating on the first main pulley 121. The power belt 33 is further prevented from disengaging by pressing the limiting pulley 28.

Furthermore, the first embodiment of the present disclosure includes two guiding rods 50 disposed apart on the training machine 60 and parallel to the outer face 21 of the power box 20. In addition, a plurality of sliding sleeves 51 are sleeved around the two guiding rods 50, and each of the sliding sleeves 51 has a circular retaining groove 511. Moreover, the cable set 10 has a horizontal guide plate 13 disposed between the rubber belt 11 and the movable pulley block 12, and the horizontal guide plate 13 has two U-shaped first retaining portions 131 at both ends for respectively assembled with the circular retaining groove 511 of the sliding sleeve 51. Therefore, when both ends of the movable pulley block 12 are pulled by the rubber belt 11 and the power belt 33, the horizontal guide plate 13 slides and lifts along the two guide rods 50 with the sliding sleeves 51. The sliding sleeves 51 provide a stable guide for the movable pulley block 12 to rise and fall smoothly and reduce the noise caused by vibration.

Further, the cable set 10 includes an L-joint plate 14 connected with the rubber belt 11 and the movable pulley block 12. The L-joint plate 14 consists of a horizontal plate 141 and a vertical plate 142 connected with the rubber belt 11. The rubber belt 11 has a folded section 111 corresponding to the L-joint plate 14 and clamping two first plates 112, and a plurality of screws 113 threadedly engage the folded section 111 and the two first plates 112 to the vertical plate 142. Furthermore, the cable set 10 includes a bolt 15, and the movable pulley block 12 has a top plate 122, the bolt 15 passes through the horizontal plate 141 and the top plate 122, and screws threadedly with a nut 151. Therefore, the rubber belt 11, the L-joint 14 and the movable pulley block 12 are threadedly engaged through the bolts 15, and easy to assemble.

Figure 6:
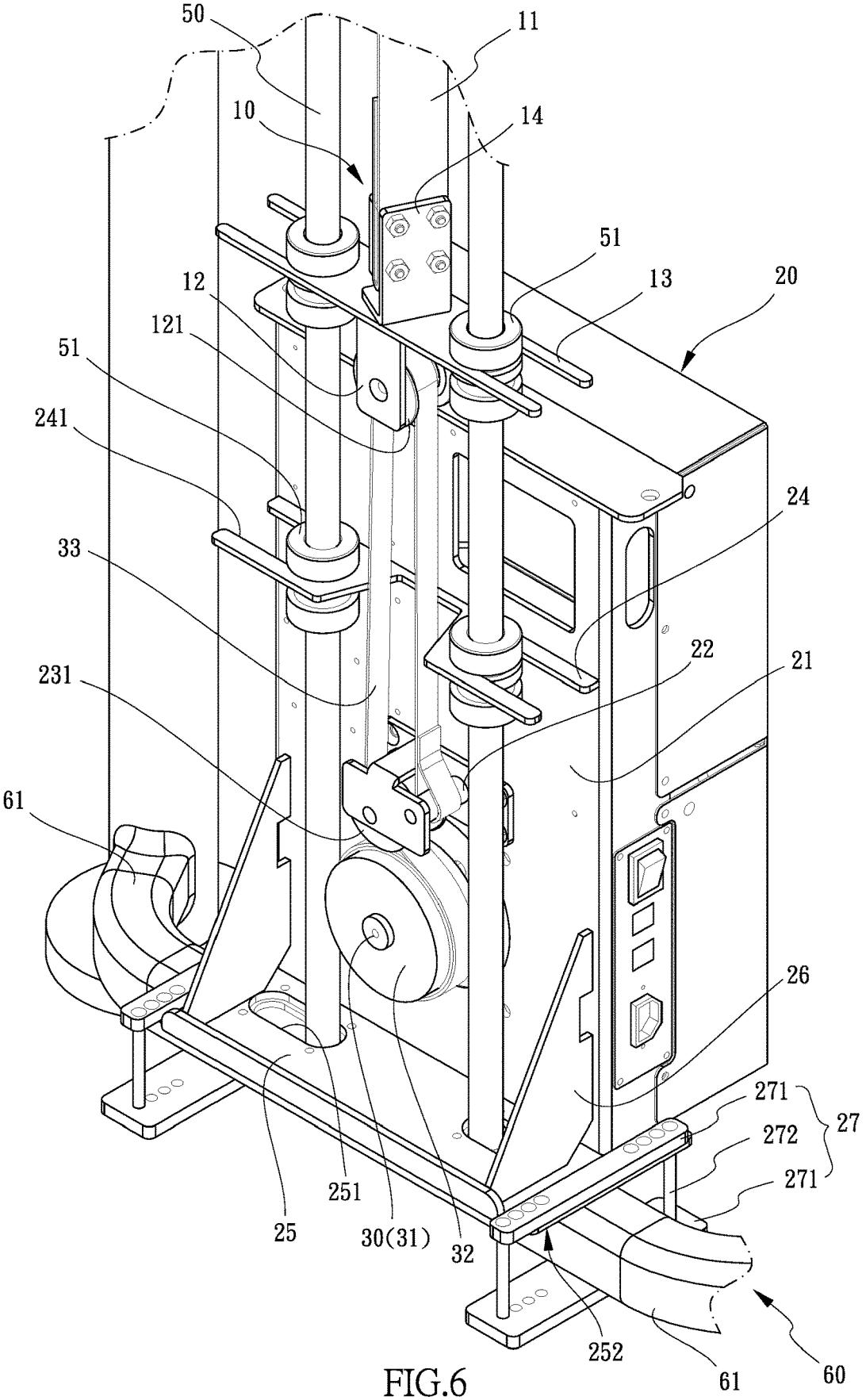
FIG. 6 is a partial enlarged perspective schematic view of the lower section structure of FIG. 4.

In addition, as shown in FIGS. 1 and 6, the power box 20 has a horizontal fixed plate 24 connected to the outer face 21 and disposed between the two guiding rods 50, and the horizontal fixed plate 24 has two U-shaped second retaining portions 241 at both ends for respectively assembled with the circular retaining groove 511 of the sliding sleeve 51. Therefore, the engagement provides solid support to the two guiding rods 50, so as to improve the stability and smoothness of lifting and guiding the movable pulley block 12 and the horizontal guide plate 13 along the two guiding rods 50.

Figure 7:
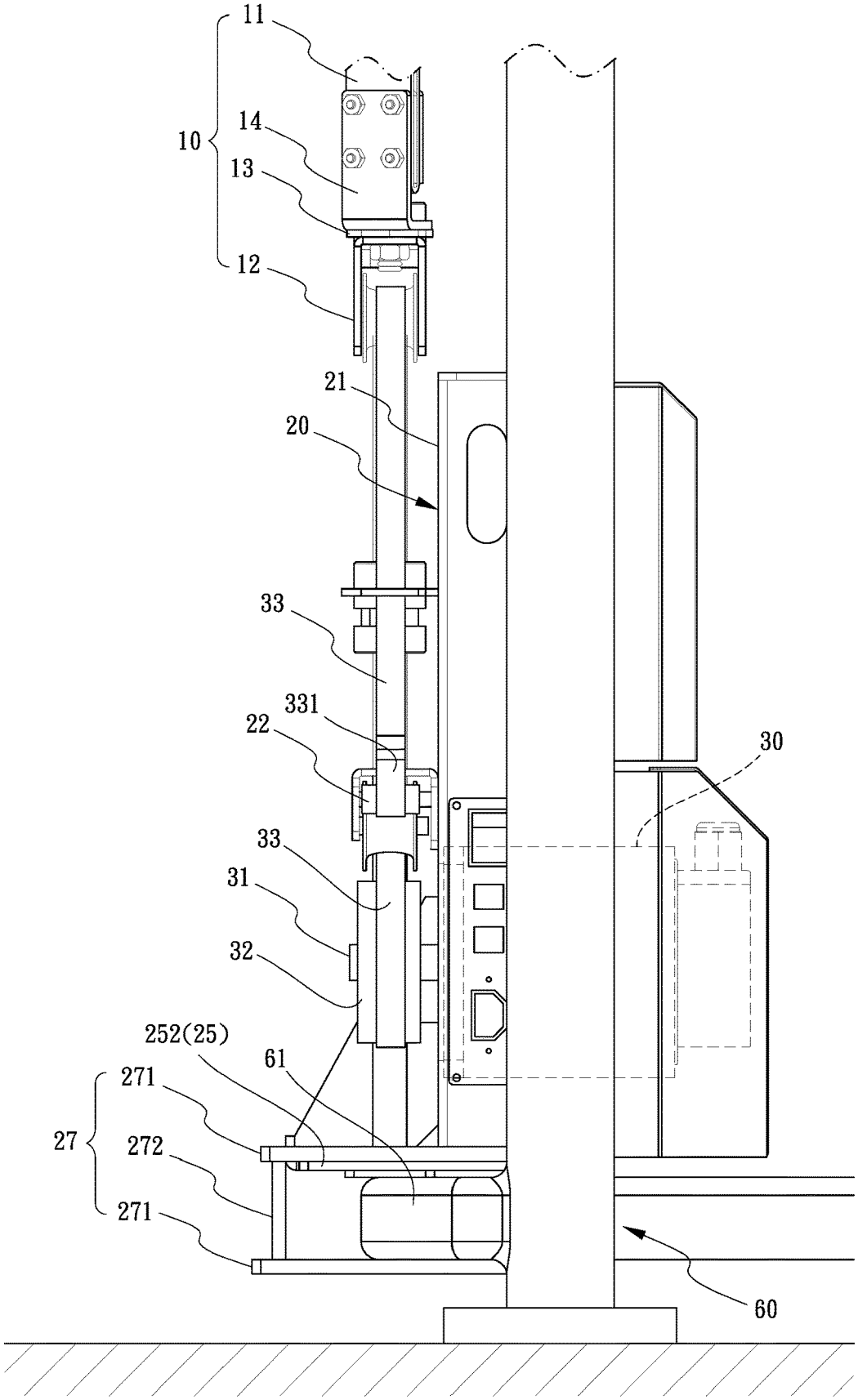
FIG. 7 is a partial enlarged planar schematic view of the side view of the first embodiment of the present disclosure in operation.
Figure 8:
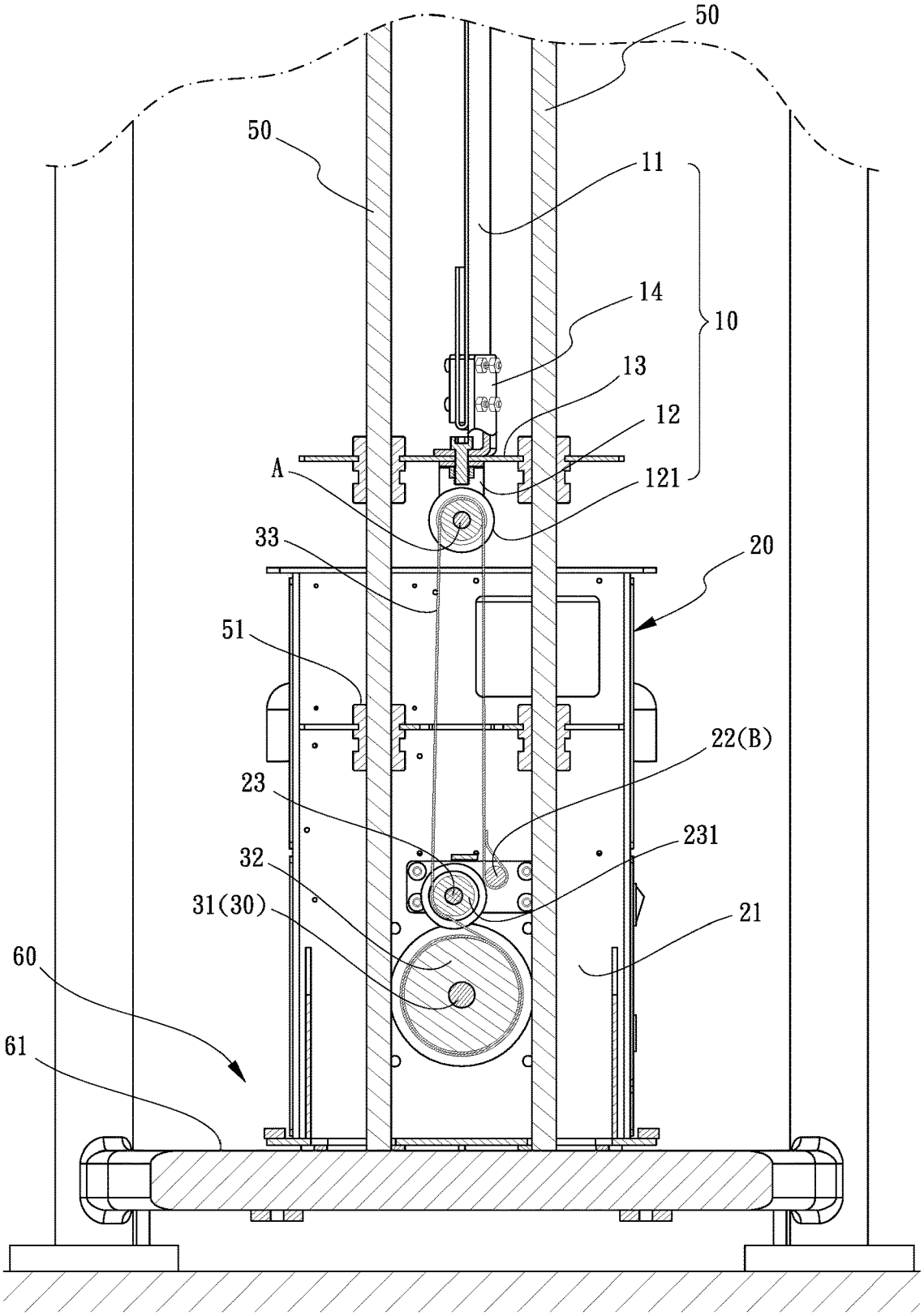
FIG. 8 is a sectional schematic view of line VIII-VIII of FIG. 4.
Figure 8A:
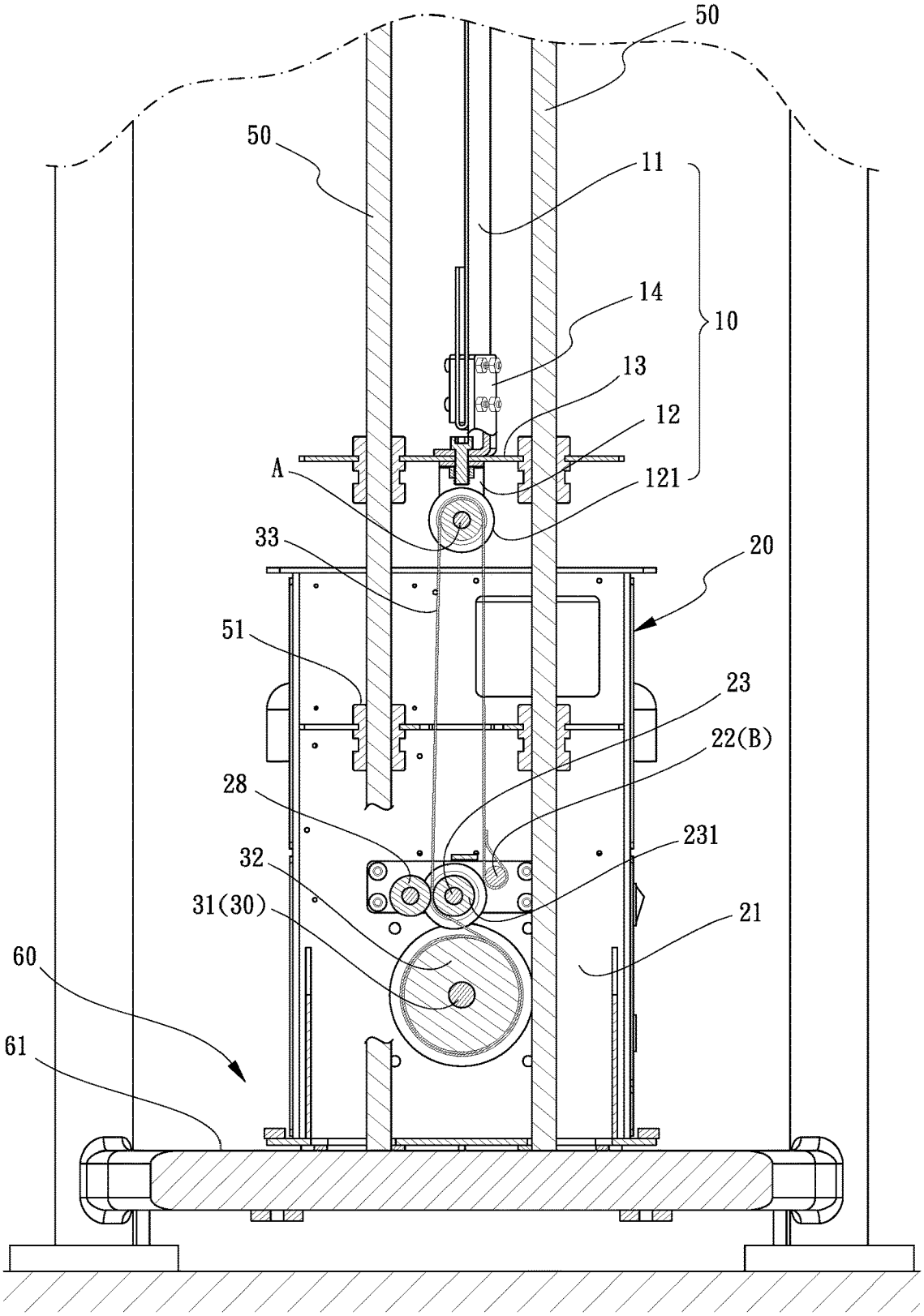
FIG. 8A is a sectional schematic view of another assembled structure of the first embodiment of the present disclosure.

Moreover, as shown in FIGS. 1, 6 and 7, the power box 20 has two support plates 26 and a base plate 25 for providing a mounting combination. The base plate 25 is connected with the bottom side of the power box 20 and extends toward and beyond the outer face 21. Further, each of the two support plates 26 has a first lateral side and a second lateral side, the first lateral side is connected to the outer face 21 and the second lateral side is connected to the base plate 25. The base plate 25 has two elongated-shaped adjusting holes 251 located between the two support plates 26, and the longitudinal direction of the two adjusting holes 251 is parallel to the outer face 21. Therefore, through the arrangement of the longitudinal direction of the two adjusting holes 251 is parallel to the outer face 21, the assembling with the training machine 60 can be simple and fast. Moreover, the two elongated-shaped adjusting holes 251 provide greater flexibility and applicability to assemble with different training machines 60 with different distances between the two guiding rods 50.

In addition, as shown in FIGS. 1, 6 and 7, the power box 20 has two fasten assemblies 27 including two second plates 271 and two long fasteners 272 for threadedly engaging the two second plates 271, and the base plate 25 has two sets of threaded holes 252 disposed and spaced apart at the outer side of the two support plates 26. The two sets of threaded holes 252 have a plurality of threaded holes spaced apart, the two fasten assemblies having the two long fasteners (bolts or screws) threadedly engage the base frame of the training machine 60. The plurality of threaded holes of the two sets of threaded holes 252 can provide a suitable distance for different sizes of the base frame 61 of the training machines 60.

Lastly, as shown in FIGS. 11-14, the second embodiment of the present disclosure, the structure difference between the first embodiment and the second embodiment is that the cable set 10 of the second embodiment is a cable belt 16 (which can be a steel cable material structure), and a connecting rod 17 connecting to one end the movable pulley block 12. In detail, the connecting rod 17 has a small diameter thread segment 171 opposite the cable belt 16. The small diameter thread section 171 passes through the horizontal guide plate 13 and the top plate 122 into the movable pulley block 12 and is fastened with a nut 172. Through the connecting rod 17, the combination, the cable belt 16, the movable pulley block 12 and the horizontal guide plate 13 can be easily assembled, in conjunction with the combination of the power box 20 and the resistance motor 30, meet the needs of modification and use in different brands and models of training machine 60.

Figure 15:
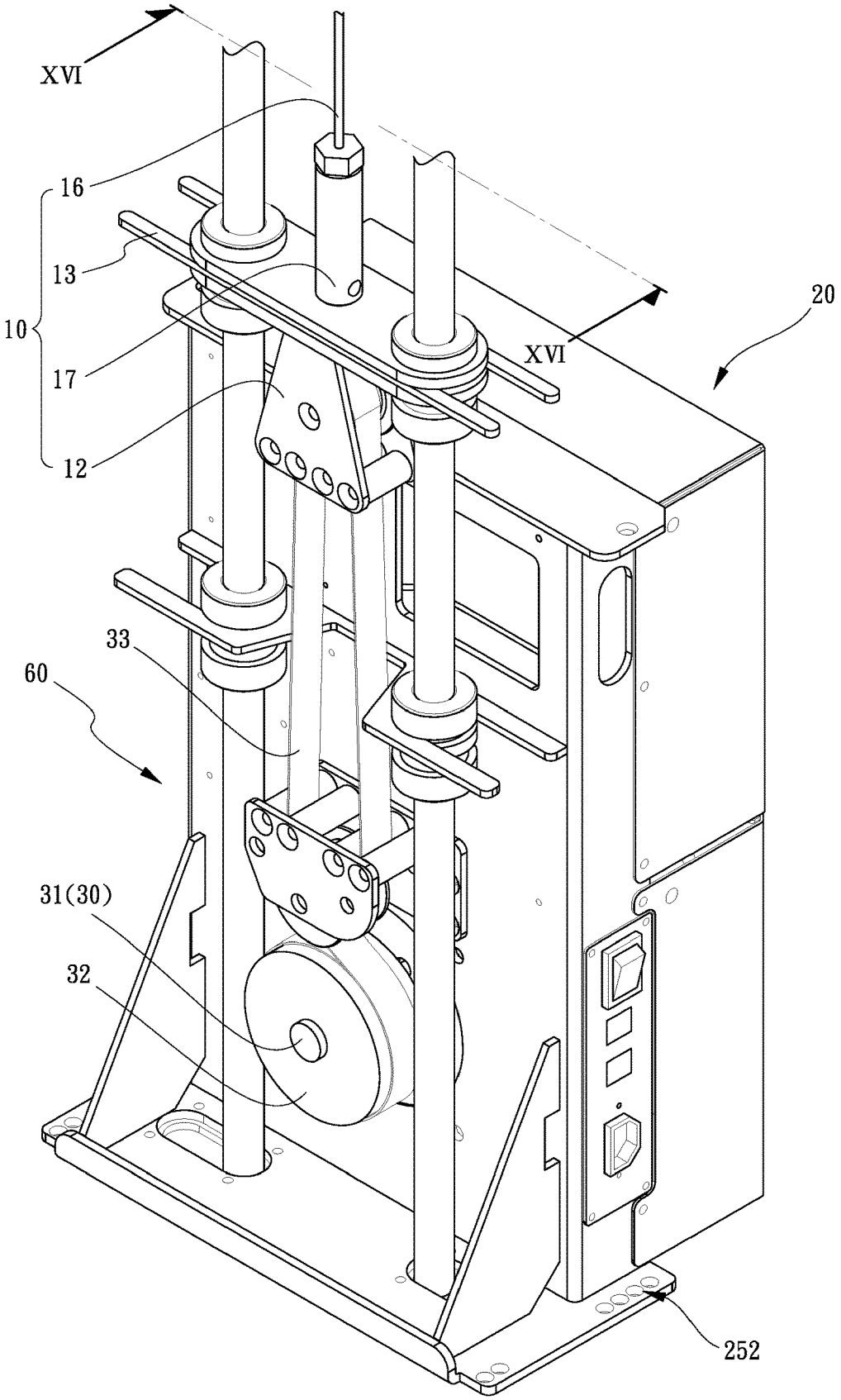
FIG. 15 is a perspective schematic view of the device with the first auxiliary pulley to the eighth auxiliary pulley of the present disclosure.
Figure 16:
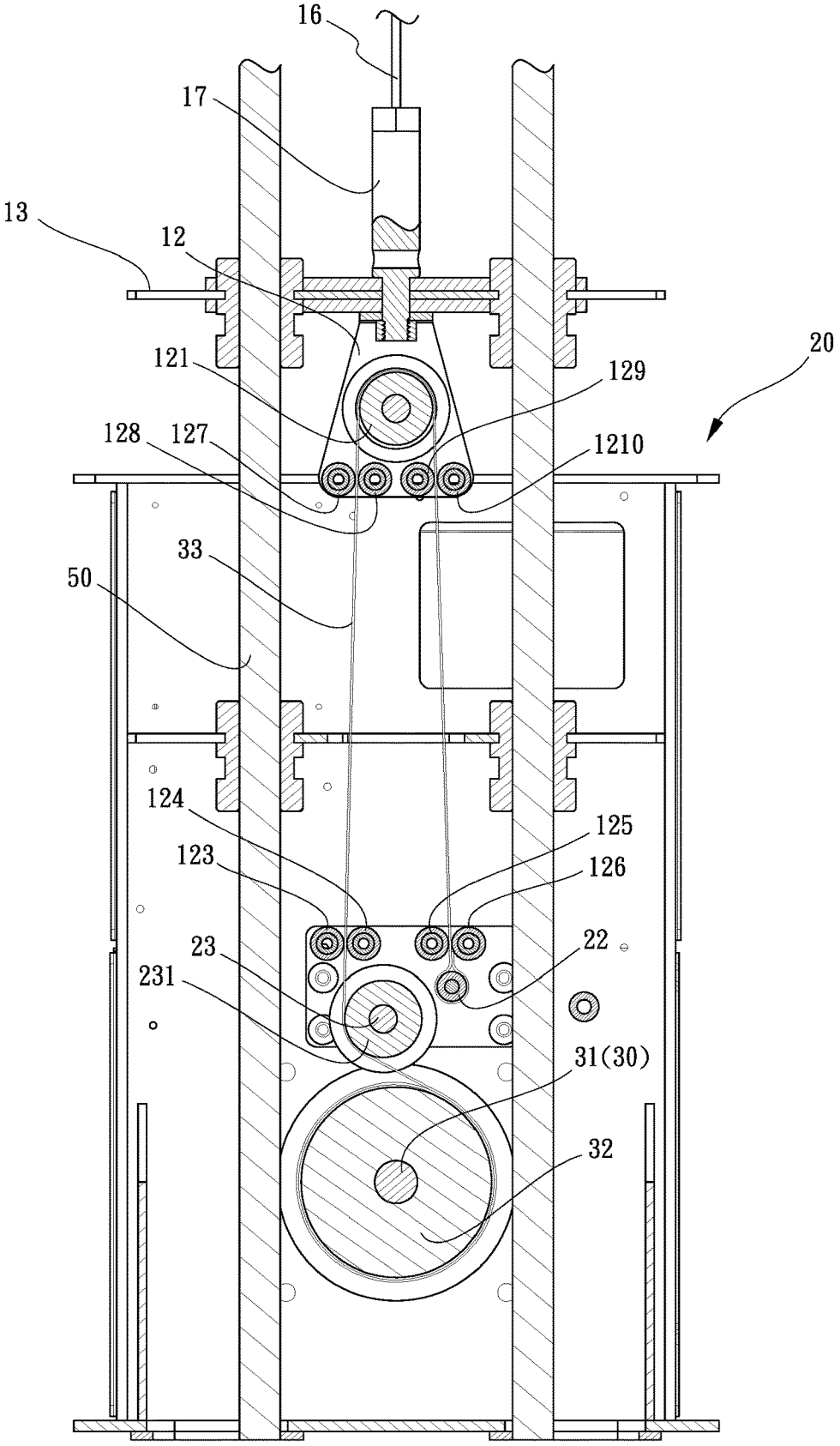
FIG. 16 is a sectional schematic view of line XV-XV of FIG. 15.

Referring to FIGS. 15 and 16, the outer face 21 of the power box 20 further provides a first auxiliary pulley 123 and a second auxiliary pulley 124 disposed above the second main pulley 231, a third auxiliary pulley 125 and a fourth auxiliary pulley 126 disposed above the positioning rod 22, a fifth auxiliary pulley 127, a sixth auxiliary pulley 128, a seventh auxiliary pulley 129 and an eighth auxiliary pulley 1210 disposed below the first main pulley 121. The power belt 33 partially passes between the first auxiliary pulley 123 and the second auxiliary pulley 124, the power belt 33 partially passes between the third auxiliary pulley 125 and the fourth auxiliary pulley 126. The power belt 33 partially passes between the fifth auxiliary pulley 127 and the sixth auxiliary pulley 128, the power belt 33 partially passes between the seventh auxiliary pulley 129 and the eighth auxiliary pulley 1210. The advantage of this structure is that the auxiliary pulleys (124~1210) can guide the power belt 33 not easy to deviate from the path during the movement process, so as to avoid the occurrence that the power belt 33 offsets from the moving path and curl and wind together.

In detail, the controller 40 includes a vibration mode; when the vibration mode is activated, the controller 40 controls the resistance motor 30 by a sine wave to perform continuous reverse resistance changes. The advantage of this vibration mode is that the primary purpose of the known fitness equipment is only to increase muscle mass and muscle endurance. Still, sensitivity training is ignored, which is very important for athletes. Sensitivity training relates to speeding up the body's reaction, such as ball games, sprinting, weightlifting, boxing, high jump, long jump, javelin, golf, and other sports that require instant explosive force. Further, explosive force is the synthesis of strength and acceleration; for athletes, to have excellent explosive power requires good muscle strength and sensitivity. The sensitivity of the body's response is related to the speed of the nerve's response. To stimulate the body's sensitivity is to stimulate the body's nerve receptors with external vibrations, such as the sensory neurons in the muscle spindle. Muscle spindles are mainly used to detect changes in muscle length. When the muscles are elongated or the striated stripes on both sides of the muscle spindles contract, the sensory nerves are excited, and the signals are transmitted to the center through the spinal cord. In order to protect the muscles, the muscle spindles will trigger reflex contractions. When the muscle contraction tension is extreme, the Gore tendon that senses muscle tension will release an inhibitory effect to relax the muscle, which is called the stretch reflex. This mechanism can quickly connect the centrifugal and concentric nerves. By stimulating proprioceptors, the motor unit's recruitment can be increased in the shortest time, and achieve a rapid increase in muscle endurance and sensitivity training. The most effective way to achieve a rapid stretch reflex is in vitro vibration. Therefore, in the vibration mode of the present disclosure, the resistance motor 30 is used as the resistance source and the resistance of the resistance motor 30 is continuously changed in a sine wave manner during use, so as to produce a vibrating effect. The resistance vibration frequency and amplitude intensity can be set independently. After the setting is completed, the operation of the device of the present disclosure will conform to the currently set vibration intensity and vibration frequency. The user only needs half of the force to easily damage the old muscles, which is most suitable for older to improve sarcopenia. Further, vibration stimulation can increase bone density to improve and prevent osteoporosis. Vibration simultaneously stimulates the sensitivity of nerves to trigger stretch reflexes, and this dual-effect training is also called explosive training. The conventional weight training machine can be upgraded to a system with explosive power training only by replacing the weight block with the device of the present invention.

Figure 17:
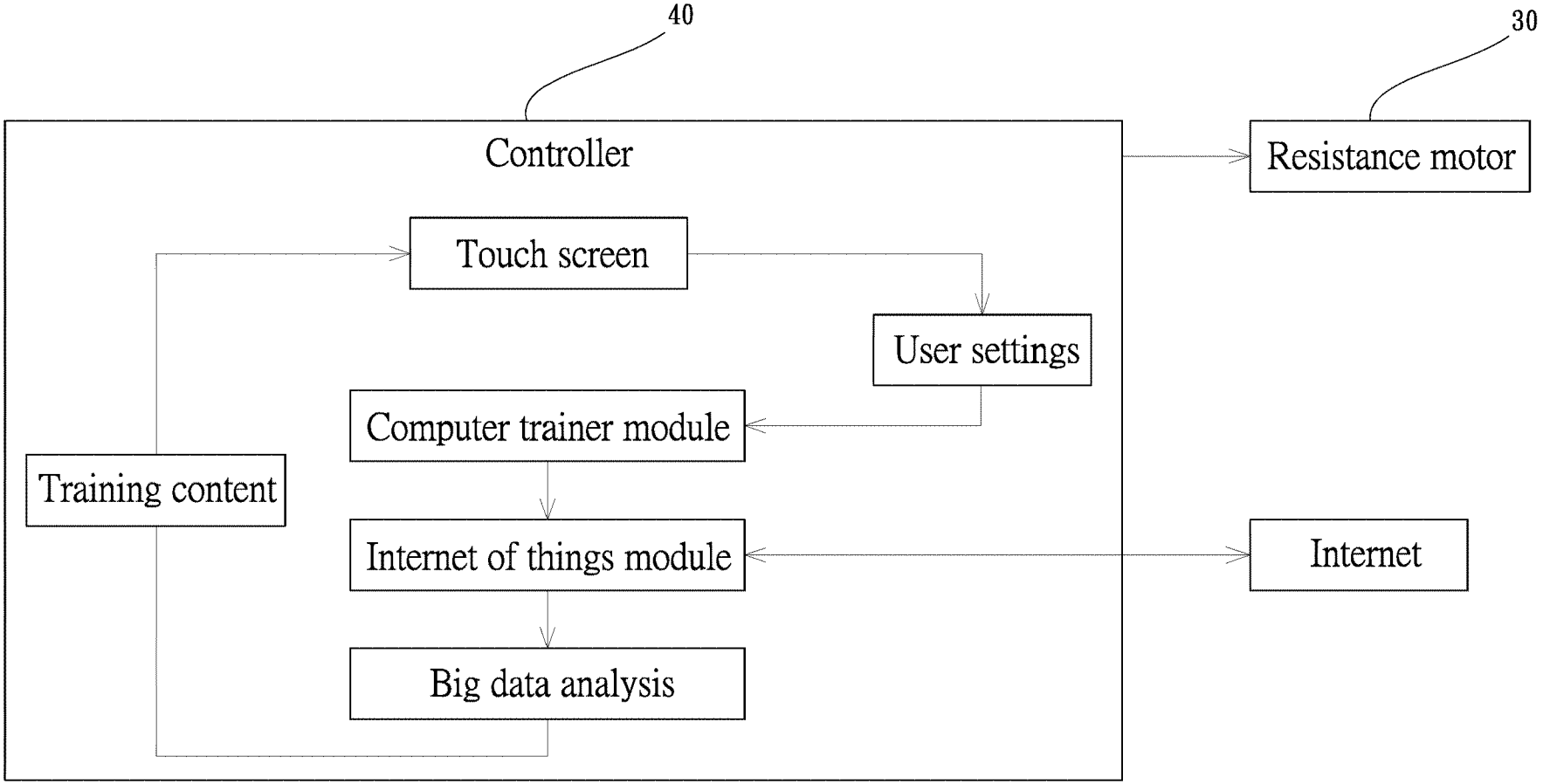
FIG. 17 is a block schematic diagram of the controller of the present disclosure in operation.

As shown in FIG. 17, the controller 40 has a human-machine interface, and includes modules (functions) such as Internet of things, big data analysis, and computer training. The Human machine interface (HMI) is convenient for users to operate intuitively, and the Internet of things function is combined with the big data analysis function, which enables the computer coach to determine the most suitable training content and training volume for the user based on the user's body data.

Figure 18:
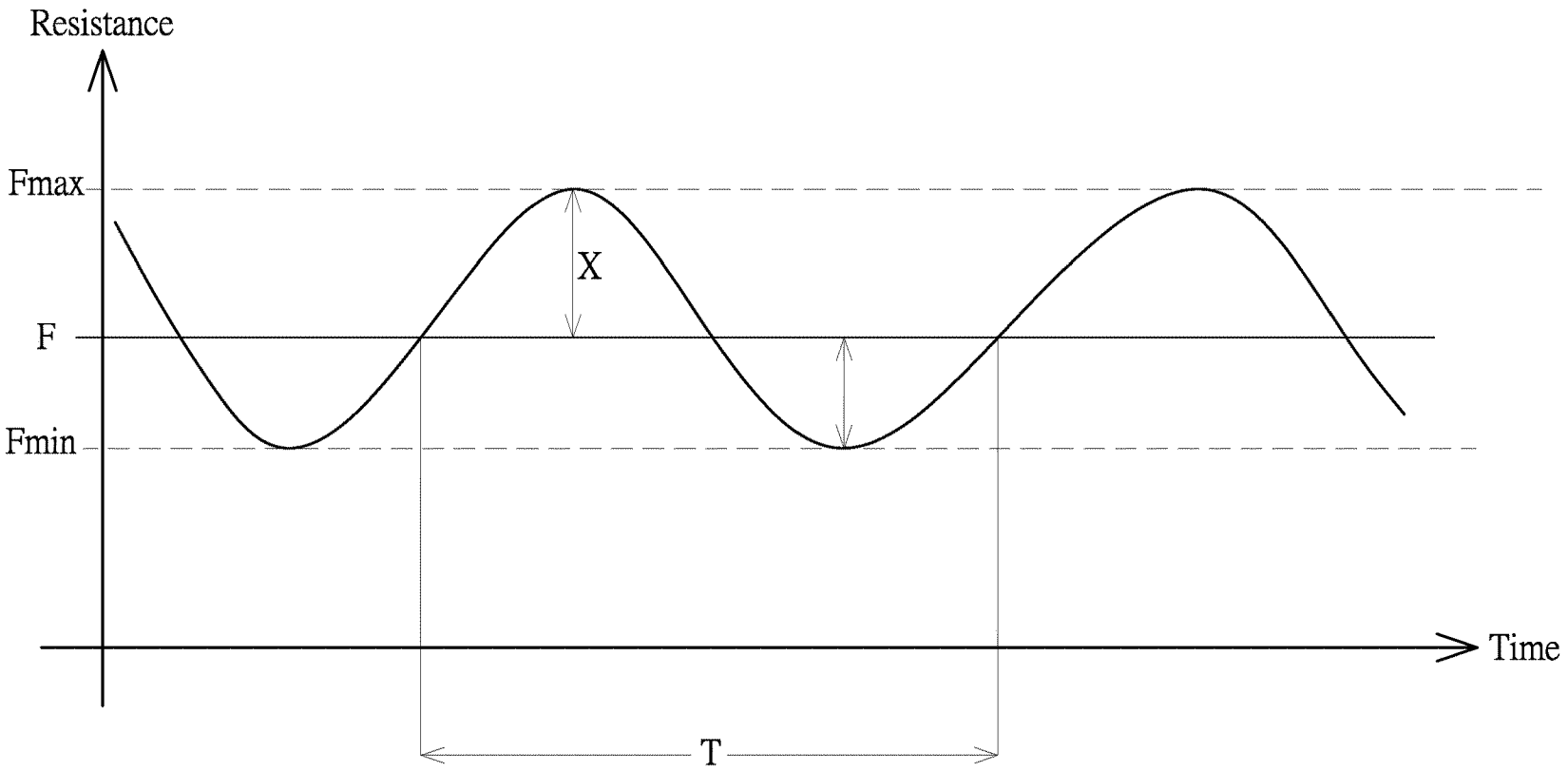
FIG. 18 is a perspective schematic view of amplitude change of the present disclosure.

In addition, as shown in FIG. 18, the parameter design template of the present disclosure can be adjusted according to the vibration amplitude in actual use. In which, resistance=F±(x %), x=0~100, resistance is generated by the motor, F is the user's force;

$$T = \frac{1}{f},$$

f=frequency. For example, F=100 kg, x=100·f=10 Hz, so that the motor force=100 kg±(100%), $F_{max}$=200 kg, $F_{min}$=0 kg.

What is claimed is:

1. An explosive strength training device, comprising:

a cable set including a rubber belt and a movable pulley block connected with one end of the rubber belt, the movable pulley block has a first main pulley disposed opposite to the rubber belt, and allows the pulling force of the rubber belt to pass through the center of the first main pulley;

a power box, including an outer face and a positioning rod protruding from the outer face;

a resistance motor, disposed in the power box and having a central axis protruding through the outer face; wherein the central axis protrudes from the outer face and is located under the positioning rod and combined with a central wheel; wherein the central wheel winds with one end of a power belt; wherein, the other end of the power belt has a sleeve-shaped fixed side; the middle section of the power belt is wound on the upper side of the first main pulley and fixedly sleeved on the positioning rod with the fixed side to form a fulcrum; and a controller electrically connected to the resistance motor, for controlling the resistance motor to output a reverse resistance force relative to the pulling force of the rubber belt on the central wheel.

2. The explosive strength training device according to claim 1, wherein the power box has a pulley rod protruding from the outer face, a second main pulley being supported by the pulley rod and limited by the positioning rod; wherein the power belt extends through the second main pulley from the side distant from the positioning rod downward to connect the central wheel; wherein the power box has a limiting pulley disposed at the opposite side to the positioning rod for limiting the power belt with the second main pulley from offsetting from the central wheel.

3. The explosive strength training device according to claim 2, further including a first auxiliary pulley and a second auxiliary pulley disposed above the second main pulley, a third auxiliary pulley and a fourth auxiliary pulley disposed above the positioning rod, a fifth auxiliary pulley, a sixth auxiliary pulley, a seventh auxiliary pulley and an eighth auxiliary pulley disposed below the first main pulley; wherein, the power belt partially passes between the first auxiliary pulley and the second auxiliary pulley, the power belt partially passes between the third auxiliary pulley and the fourth auxiliary pulley, the power belt partially passes between the fifth auxiliary pulley and the sixth auxiliary pulley, and the power belt partially passes between the seventh auxiliary pulley and the eighth auxiliary pulley.

4. The explosive strength training device according to claim 2, wherein the controller includes a vibration mode; wherein when the vibration mode is activated, the controller controls the resistance motor by a sine wave to perform continuous reverse resistance changes.

5. The explosive strength training device according to claim 2, wherein the controller has a human-machine interface, and includes an internet-of-things function, a big data analysis function, and a computer training function.

6. The explosive strength training device according to claim 1, further comprising two guiding rods disposed at a distance and parallel to the outer face of the power box; wherein a plurality of sliding sleeves are sleeved around the two guiding rods, and each of the sliding sleeves has a circular retaining groove.

7. The explosive strength training device according to claim 3, wherein the cable set has a horizontal guide plate disposed between the rubber belt and the movable pulley block, the horizontal guide plate has two U-shaped first retaining portions, with one at each end for assemblywith the circular retaining groove of a respective sliding sleeve.

8. The explosive strength training device according to claim 6, wherein the power box has a horizontal fixed plate connected to the outer face, the horizontal fixed plate has two U-shaped second retaining portions, with one at each end for assemblywith the circular retaining groove of a respective sliding sleeve.

9. The explosive strength training device according to claim 1, wherein the cable set includes an L-joint plate connected with the rubber belt and the movable pulley block; wherein the L-joint plate consists of a horizontal plate and a vertical plate connected with the rubber belt, and the rubber belt has a folded section corresponding to the L-joint plate and clamped by two first plates, and a plurality of screws threadedly engage the folded section and the two first plates to the vertical plate.

10. The explosive strength training device according to claim 9, wherein the cable set includes a bolt, and the movable pulley block has a top plate, the bolt passes through the horizontal plate and the top plate, and screws threadedly with a nut.

11. The explosive strength training device according to claim 1, wherein the power box has two support plates and a base plate for providing a mounting combination; wherein the base plate is combined with the bottom side of the power box and extends toward and beyond the outer face; wherein each of the two support plates has a first lateral side and a second lateral side, the first lateral side is connected to the outer face and the second lateral side is connected to the base plate; wherein the base plate has two elongated-shaped adjusting holes located between the two support plates, and the longitudinal direction of the adjusting hole is parallel to the outer face.

12. The explosive strength training device according to claim 11, wherein the power box has two fastening assemblies including two second plates and two long fasteners for threadedly engaging the two second plates, and the base plate has two sets of threaded holes disposed and spaced apart at the outer side of the two support plates.

13. An explosive strength training device, comprising:

a cable set including a cable belt, a connecting rod and a movable pulley block; wherein the connecting rod engages between one end of the cable belt and the movable pulley block, the movable pulley block disposed opposite to the cable belt, and allows the pulling force of the cable belt to pass through the center of the first main pulley;

a power box, including an outer face and a positioning rod protruding from the outer face;

a resistance motor, disposed in the power box and having a central axis protruding through the outer face; wherein the central axis protrudes from the outer face and is located under the positioning rod and supports a central wheel; wherein the central wheel winds with a power belt; wherein, one end of the power belt is wound on the upper side of the first main pulley and fixedly sleeved on the positioning rod with a fixed side to form a fulcrum, and the other end of the power belt is connected to the central wheel; and a controller electrically connected to the resistance motor, for controlling the resistance motor to output a reverse resistance force relative to the pulling force of the cable belt on the central wheel.

14. The explosive strength training device according to claim 13, wherein the power box has a pulley rod protruding from the outer face, a second main pulley being supported by the pulley rod and limited by the positioning rod; wherein the power belt extends through the second main pulley from the side distant from the positioning rod downward to connect to the central wheel; wherein the power box has a limiting pulley disposed at the opposite side to the positioning rod for limiting the power belt with the second main pulley from offsetting from the central wheel.

15. The explosive strength training device according to claim 14, further including a first auxiliary pulley and a second auxiliary pulley disposed above the second main pulley, a third auxiliary pulley and a fourth auxiliary pulley disposed above the positioning rod, a fifth auxiliary pulley, a sixth auxiliary pulley, a seventh auxiliary pulley and an eighth auxiliary pulley disposed below the first main pulley; wherein, the power belt partially passes between the first auxiliary pulley and the second auxiliary pulley, the power belt partially passes between the third auxiliary pulley and the fourth auxiliary pulley, the power belt partially passes between the fifth auxiliary pulley and the sixth auxiliary pulley, and the power belt partially passes between the seventh auxiliary pulley and the eighth auxiliary pulley.

16. The explosive strength training device according to claim 14, wherein the controller includes a vibration mode; wherein when the vibration mode is activated, the controller controls the resistance motor by a sine wave to perform continuous reverse resistance changes.

17. The explosive strength training device according to claim 14, wherein the controller has a human-machine interface, and includes an internet-of-things function, a big data analysis function, and a computer training function.

* * * * *